US010059094B2

(12) United States Patent
Fujita

(10) Patent No.: US 10,059,094 B2
(45) Date of Patent: Aug. 28, 2018

(54) RECORDING APPARATUS FOR EJECTING INK

(71) Applicant: SEIKO EPSON CORPORATION, Tokyo (JP)

(72) Inventor: Toru Fujita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/673,000

(22) Filed: Aug. 9, 2017

(65) Prior Publication Data

US 2017/0334197 A1 Nov. 23, 2017

Related U.S. Application Data

(63) Continuation of application No. 15/067,254, filed on Mar. 11, 2016, now Pat. No. 9,764,545.

(30) Foreign Application Priority Data

Mar. 20, 2015 (JP) ..... 2015-057839

(51) Int. Cl.
*B41J 2/045* (2006.01)
*B41J 2/21* (2006.01)
(Continued)

(52) U.S. Cl.
CPC ..... *B41J 2/04508* (2013.01); *B41J 2/04586* (2013.01); *B41J 2/2054* (2013.01);
(Continued)

(58) Field of Classification Search
CPC .. B41J 2/04508; B41J 2/2054; B41J 2/04586; B41J 19/142; B41J 2/2114; B41J 3/4078
See application file for complete search history.

(56) References Cited

U.S. PATENT DOCUMENTS 5,635,969 A 6/1997 Allen
6,299,285 B1 * 10/2001 Inui ..... B41J 2/2056 347/15
(Continued)

FOREIGN PATENT DOCUMENTS

EP 0726155 A2 8/1996
JP 2014-000703 A 1/2014
(Continued)

OTHER PUBLICATIONS

Extended European Search Report for the corresponding European Patent Application No. 16159614.3 dated Jul. 27, 2016.

*Primary Examiner* — Bradley Thies

(57) ABSTRACT

The recording method includes ejecting a first ink for image forming and a substantially colorless second ink onto a recording surface of a recording medium at an ejecting unit, and controlling ejecting operations of the first ink and the second ink in the ejecting unit. The second ink is permeation ink configured to permeate the first ink into the recording medium from the recording surface to an opposite surface of the recording medium, and the opposite surface is opposite the recording surface. The controlling includes performing a plurality of ejecting operations of the first ink with respect to one ejecting operation of the second ink, so that at least a part of a landing position of the second ink and a landing position of the first ink overlap on the recording medium.

14 Claims, 6 Drawing Sheets

(51) Int. Cl.
*B41J 19/14* (2006.01)
*B41J 2/205* (2006.01)
*B41J 3/407* (2006.01)

(52) U.S. Cl.
CPC ..... *B41J 2/2114* (2013.01); *B41J 19/142* (2013.01); *B41J 3/4078* (2013.01)

(56) References Cited

U.S. PATENT DOCUMENTS

| | | | |
|---|---|---|---|
| 8,328,339 | B2 | 12/2012 | Grasselli |
| 2009/0153606 | A1 | 6/2009 | Mizutani et al. |
| 2014/0085364 | A1 | 3/2014 | Otake |
| 2015/0360464 | A1 | 12/2015 | Katsumura et al. |

FOREIGN PATENT DOCUMENTS

| | | | |
|---|---|---|---|
| JP | 2014-208424 | A | 11/2014 |
| WO | 2008/010705 | A1 | 1/2008 |

* cited by examiner

RECORDING APPARATUS FOR EJECTING INK

CROSS-REFERENCE TO RELATED APPLICATIONS

This application is a continuation application of U.S. patent application Ser. No. 15/067,254 filed on Mar. 11, 2016. This application claims priority under 35 U.S.C. § 119 to Japanese Patent Application No. 2015-057839, filed on Mar. 20, 2015. The entire disclosures of U.S. patent application Ser. No. 15/067,254 and Japanese Patent Application No. 2015-057839 are hereby incorporated herein by reference.

BACKGROUND

1. Technical Field

The present invention relates to a recording apparatus.

2. Related Art

In the related art, a recording apparatus which performs recording by ejecting ink on a recording medium (medium) from nozzles has been disclosed. As such a recording apparatus, for example, a recording apparatus which can perform recording on cloth has been disclosed, as disclosed in JP-A-2014-703.

In a recording apparatus in recent years, recording of various forms is executed with respect to a recording medium of various types. For example, as disclosed in U.S. Pat. No. 8,328,339, there is a case in which recording is performed so that ink sufficiently permeates into a face on a side opposite to a recording face, not only the recording face onto which ink is ejected with respect to cloth as a recording medium. In such a case, in addition to the ink for image forming, permeation ink for causing the ink for image forming to sufficiently permeate into the face on the side opposite to the recording face is ejected onto the recording medium so that at least a part of permeation ink overlaps the ink for image forming. However, when executing recording on thick cloth, for example, using permeation ink, a coloring material of the ink for image forming is dispersed in the entire thickness direction of cloth, and there has been a case in which density of an image becomes low.

In the recording apparatus in the related art which is disclosed in JP-A-2014-703 and U.S. Pat. No. 8,328,339, there is no configuration sufficiently suppressing low density by assuming such a recording mode. That is, there is not a configuration in which it is possible to sufficiently suppress low density of an image, in a case in which the image is formed by ejecting ink for image forming and permeation ink.

In addition, in recent years, permeation ink has also been used at a portion with a dark color since recording is performed on thick cloth, and accordingly, there has been a problem of low density, also at a portion with high density. In U.S. Pat. No. 8,328,339, the fact of promoting permeation of ink at a portion with a light color, particularly, by performing recording using ink for image forming and permeation ink at the same time is described; however, there is no description on a measure for low density which occurs along with permeation, and no configuration of solving such a problem.

SUMMARY

An advantage of some aspects of the invention is to suppress low density of an image in a case of forming an image by ejecting ink for image forming and permeation ink.

According to the first aspect of the invention, the recording method includes ejecting a first ink for image forming and a substantially colorless second ink onto a recording surface of a recording medium at an ejecting unit, and controlling ejecting operations of the first ink and the second ink in the ejecting unit. The second ink is permeation ink configured to permeate the first ink into the recording medium from the recording surface to an opposite surface of the recording medium, and the opposite surface is opposite the recording surface. The controlling includes performing a plurality of ejecting operations of the first ink with respect to one ejecting operation of the second ink, so that at least a part of a landing position of the second ink and a landing position of the first ink overlap on the recording medium.

According to the first aspect of the invention, the ejecting includes ejecting the first ink from a first ejecting unit, and the second ink from a second ejecting unit while reciprocating the ejecting unit in a reciprocating direction, and the first ejecting unit is provided on both sides of the second ejecting unit in the reciprocating direction.

According to the first aspect of the invention, the ejecting includes ejecting the first ink from a first ejecting unit, and the second ink from a second ejecting unit while reciprocating the ejecting unit in a reciprocating direction, and the controlling includes performing an ejecting operation of the first ink at least once with respect to the same recording region in both an outward direction and a return direction in the reciprocating direction.

According to the first aspect of the invention, the controlling includes executing a plurality of ejecting operations of the first ink so that each ejecting amount becomes equal.

According to the first aspect of the invention, the controlling includes executing a plurality of ejecting operations of the first ink so that an ejecting amount in the previous ejecting operation is larger than an ejecting amount in the subsequent ejecting operation.

According to the first aspect of the invention, the controlling includes executing a plurality of ejecting operations of the first ink so that an ejecting amount in the previous ejecting operation is smaller than an ejecting amount in the subsequent ejecting operation.

According to the first aspect of the invention, the ejecting includes ejecting the first ink and the second ink at the ejecting unit that includes a first ejecting unit configured to eject the first ink and a second ejecting unit configured to eject the second ink, the first ejecting unit has a plurality of first nozzle columns and a plurality of second nozzle columns, the plurality of the first nozzle columns is arranged in a first direction relative to the second ejecting unit, the plurality of the second nozzle columns is arranged in a second direction relative to the second ejecting unit, and the second direction is opposite the first direction.

According to the first aspect of the invention, a number of the plurality of the first nozzle columns is equal to a number of the plurality of the second nozzle columns.

According to the second aspect of the invention, the recording method includes moving an ejecting unit in a reciprocating direction, ejecting a first ink for image forming and a substantially colorless second ink onto a recording surface of a recording medium by the ejecting unit, and controlling ejecting operations of the first ink and the second ink in the ejecting unit. The second ink is permeation ink configured to permeate the first ink into the recording medium from the recording surface to an opposite surface of the recording medium, and the opposite surface is opposite the recording surface. The controlling includes controlling the ejecting unit to perform a plurality of ejecting operations of the first ink with respect to at least one ejecting operation of the second ink. The controlling includes controlling the ejecting unit to eject both of the first ink and the second ink while the ejecting unit is moving in one direction of the reciprocating direction, and controlling the ejecting unit to eject both of the first ink and the second ink while the ejecting unit is moving in an opposite direction of the reciprocating direction, and the opposite direction is opposite the one direction.

According to the third aspect of the invention, a recording method includes ejecting a first ink for image forming onto a recording surface of a recording medium by a plurality of first nozzle columns of an ejecting unit and ejecting a substantially colorless second ink onto the recording surface of the recording medium by a second nozzle column of the ejecting unit, and controlling ejecting operations of the first ink and the second ink in the ejecting unit. The first nozzle columns is arranged symmetrically with respect to the second nozzle column, the second ink is permeation ink configured to permeate the first ink into the recording medium from the recording surface to an opposite surface of the recording medium, and the opposite surface is opposite the recording surface. The controlling includes controlling the ejecting unit to perform a plurality of ejecting operations of the first ink with respect to one ejecting operation of the second ink.

According the third aspect of the invention, the first nozzle columns are arranged symmetrically with respect to the second nozzle column in a reciprocating direction in which the ejecting unit reciprocates.

According the fourth aspect of the invention, a recording apparatus includes an ejecting unit configured to move in a reciprocating direction and to eject a first ink for image forming and a substantially colorless second ink onto a recording surface of a recording medium, and a control unit which is configured to control ejecting operations of the first ink and the second ink in the ejecting unit. The second ink is permeation ink configured to permeate the first ink into the recording medium from the recording surface to an opposite surface of the recording medium, and the opposite surface is opposite the recording surface. The control unit is arranged to control the ejecting unit to perform a plurality of ejecting operations of the first ink with respect to at least one ejecting operation of the second ink. The control unit is arranged to control the ejecting unit to eject both of the first ink and the second ink while the ejecting unit is moving in one direction of the reciprocating direction, and control the ejecting unit to eject both of the first ink and the second ink while the ejecting unit is moving in an opposite direction of the reciprocating direction, and the opposite direction is opposite the one direction.

According to the fifth aspect of the invention, a recording apparatus includes an ejecting unit which includes a plurality of first nozzle columns configured to eject a first ink for image forming and a second nozzle column configured to eject a substantially colorless second ink onto a recording surface of a recording medium, and a control unit which is configured to control ejecting operations of the first ink and the second ink in the ejecting unit. The second ink is permeation ink configured to permeate the first ink into the recording medium from the recording surface to an opposite surface of the recording medium, and the opposite surface is opposite the recording surface. The control unit is arranged to control the ejecting unit to perform a plurality of ejecting operations of the first ink with respect to one ejecting operation of the second ink. The first nozzle columns is arranged symmetrically with respect to the second nozzle column.

According to the fifth aspect of the invention, the first nozzle columns are arranged symmetrically with respect to the second nozzle column in a reciprocating direction in which the ejecting unit reciprocates.

BRIEF DESCRIPTION OF THE DRAWINGS

Embodiments of the invention will now be described by way of example only with reference to the accompanying drawings, wherein like numbers reference like elements.

DESCRIPTION OF EXEMPLARY EMBODIMENTS

First Embodiment (FIGS. 1 to 3C)

Hereinafter, a recording apparatus according to a first embodiment of the invention will be described in detail with reference to accompanying drawings.

First, an outline of a recording apparatus 1 according to the first embodiment of the invention will be described.

Figure 1:
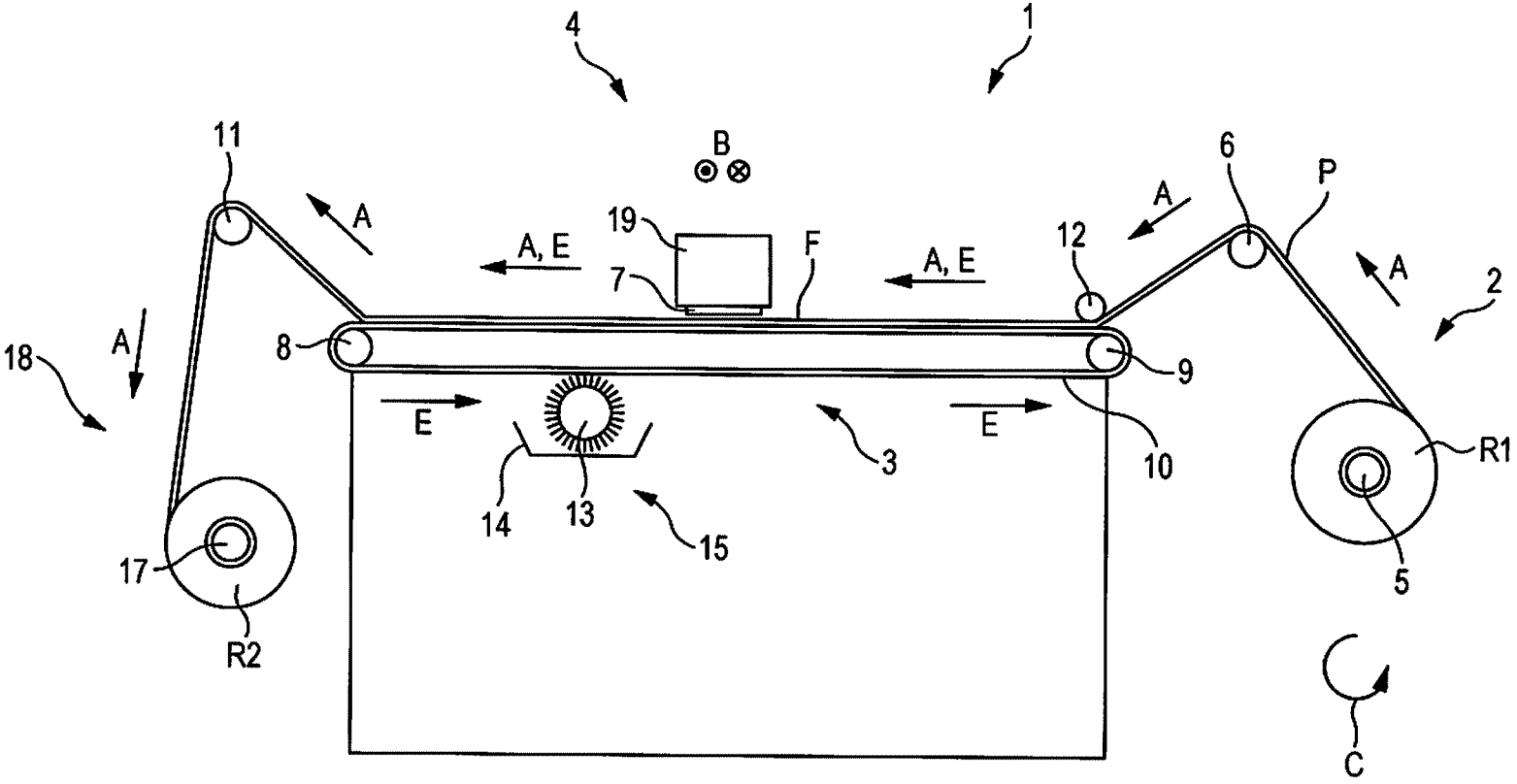
FIG. 1 is a schematic side view of a recording apparatus according to a first embodiment of the invention.

FIG. 1 is a schematic side view of the recording apparatus 1 according to the first embodiment.

The recording apparatus 1 according to the embodiment includes a feeding unit 2 which can send out a roll R1 of a recording medium (medium) P for performing recording. The recording apparatus further includes a transport mechanism 3 which transports the recording medium P in a transport direction A using an adhesive belt 10 (endless belt) which supports the recording medium P on a support face F onto which an adhesive is attached. The recording apparatus further includes a recording mechanism 4 which performs recording by causing a carriage 19 which includes a recording head 7 as an ejecting unit to reciprocate in a reciprocating direction B which intersects the transport direction A of the recording medium P. The recording apparatus further includes a washing mechanism 15 of the adhesive belt 10. In addition, the recording apparatus further includes a winding mechanism 18 including a winding shaft 17 which winds up the recording medium P.

The feeding unit 2 includes a rotating shaft 5 as a setting position of the roll R1 of the recording medium P for performing recording, and can feed the recording medium P to the transport mechanism 3 through a driven roller 6 from the roll R1 which is set on the rotating shaft 5. In addition, when feeding the recording medium P to the transport mechanism 3, the rotating shaft 5 rotates in a rotation direction C.

The transport mechanism 3 includes the adhesive belt 10 which transports the recording medium P which is fed from the feeding unit 2 by mounting the medium thereon, and a driving roller 8 and a driven roller 9 which move the adhesive belt 10 in a direction E. The recording medium P is mounted on the support face F of the adhesive belt 10 by being pressurized and attached using a pressurizing roller 12. In addition, when transporting the recording medium P, the driving roller 8 rotates in the rotation direction C.

However, the endless belt as a transport belt is not limited to the adhesive belt. For example, an electrostatic suctioning-type endless belt may be used.

The recording apparatus 1 according to the embodiment has a configuration in which it is possible to use cloth as the recording medium P, by including the transport mechanism with such a configuration. However, it is not limited to the transport mechanism with such a configuration, and may be a transport mechanism with a configuration in which the recording medium P is transported by being supported by a movable support tray, or a configuration in which the recording medium P is transported using a pair of rollers, or the like. In addition, it may be a recording apparatus of a so-called flatbed type in which recording is performed by fixing the recording medium P to a support unit, and the recording head 7 is moved with respect to the fixed recording medium.

The recording mechanism 4 includes a carriage motor 30 (refer to FIG. 2) which causes the carriage 19 including the recording head 7 to reciprocate in the reciprocating direction B. In addition, the reciprocating direction B in FIG. 1 is a direction perpendicular to a plane on which FIG. 1 is represented.

When performing recording, the carriage 19 including the recording head 7 is caused to perform reciprocating scanning; however, the transport mechanism 3 stops transporting of the recording medium P in the middle of scanning for recording (in the middle of moving of carriage 19). In other words, when performing recording, reciprocating scanning of the carriage 19 and transporting of the recording medium P are alternately performed. That is, when performing recording, the transport mechanism 3 causes the recording medium P to be intermittently transported (intermittent movement of adhesive belt 10) corresponding to reciprocating scanning of the carriage 19.

In addition, though it will be described in detail later, the recording apparatus 1 according to the embodiment has a configuration in which it is possible to perform recording by ejecting permeation ink as second ink I2 (refer to FIGS. 3A to 3C) from the recording head 7, in addition to color ink for image forming as first ink I1 (refer to FIGS. 3A to 3C). For this reason, it is a configuration in which it is possible to perform recording so that ink I sufficiently permeates onto a face on a side opposite to a recording face, not only the recording face onto which the ink I (refer to FIGS. 3A to 3C) is ejected, when cloth is used as the recording medium P, for example.

The washing mechanism 15 of the adhesive belt 10 includes a washing brush 13 to which a plurality of washing rollers are connected in a rotating shaft direction, and a tray 14 in which a detergent for washing the washing brush 13 is filled.

The winding mechanism 18 is a mechanism which winds up the recording medium P on which recording is performed, and which is transported from the transport mechanism 3 through a driven roller 11, and can wind up the medium as a roll R2 of the recording medium P, by setting a paper tube for winding on the winding shaft 17, and winding the recording medium P around the paper tube.

Subsequently, an electrical configuration in the recording apparatus 1 according to the embodiment will be described.

Figure 2:
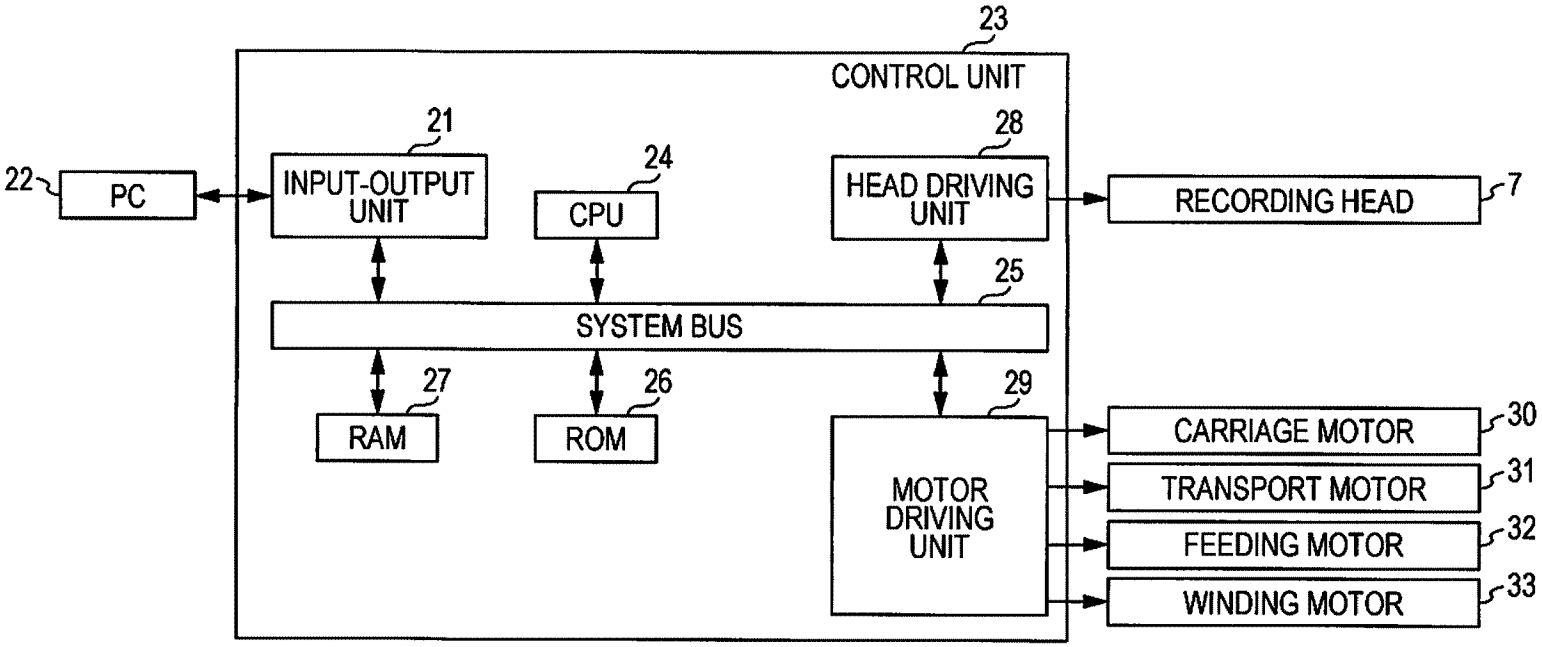
FIG. 2 is a block diagram which illustrates the recording apparatus according to the first embodiment of the invention.

FIG. 2 is a block diagram of the recording apparatus 1 according to the embodiment.

A CPU 24 which is in charge of a control of the entire recording apparatus 1 is provided in the control unit 23. The CPU 24 is connected to a ROM 26 which stores various control programs, or the like, which are executed by the CPU 24, and a RAM 27 which can temporarily store data through a system bus 25.

In addition, the CPU 24 is connected to a head driving unit 28 for driving the recording head 7 through the system bus 25.

The CPU 24 is connected to a motor driving unit 29 for driving the carriage motor 30, a transport motor 31, a feeding motor 32, and a winding motor 33 through the system bus 25.

Here, the carriage motor 30 is a motor for moving the carriage 19 including the recording head 7. In addition, the transport motor 31 is a motor for driving the driving roller 8. The feeding motor 32 is a motor which is a rotation mechanism of the rotating shaft 5, and which drives the rotating shaft 5 for sending the recording medium P to the transport mechanism 3. In addition, the winding motor 33 is a driving motor for rotating the winding shaft 17.

In addition, the CPU 24 is connected to an input-output unit 21 through the system bus 25, and the input-output unit 21 is connected to a PC 22 for performing transceiving of data such as recording data, and a signal.

Subsequently, the carriage 19 which is a main portion of the recording apparatus 1 according to the embodiment will be described.

Figure 3A:
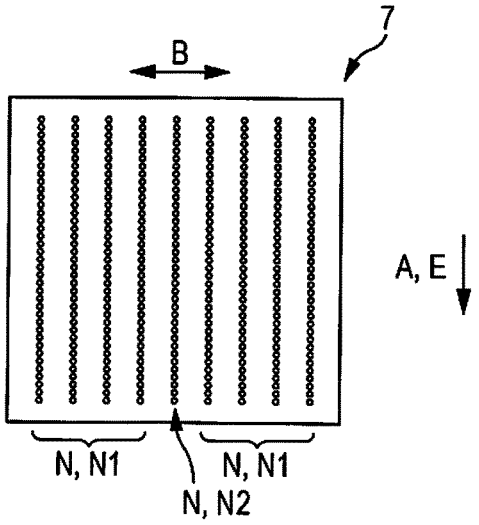
FIGS. 3A to 3C are schematic views which illustrate main portions of the recording apparatus according to the first embodiment of the invention.
Figure 3B:
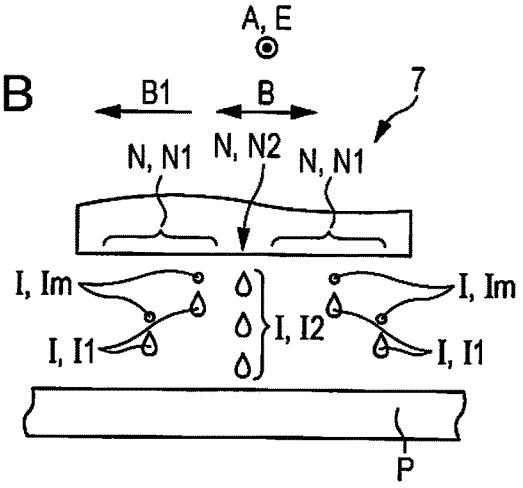
Figure 3C:
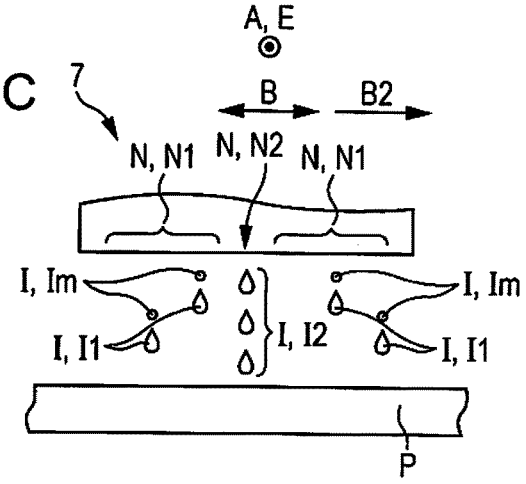

FIGS. 3A to 3C are schematic views which illustrate the recording head 7 which is provided in the carriage 19 according to the embodiment. Among these, FIG. 3A is a schematic bottom view of the recording head 7, and FIGS. 3B and 3C are schematic front views of the recording head 7.

As described above, the recording apparatus 1 according to the embodiment can perform recording by ejecting the first ink I1 as color ink for image forming, and the second ink I2 as permeation ink from the recording head 7. Here, the second ink I2 as the permeation ink is ink which supports permeation of the first ink I1 as the color ink for image forming with respect to the recording medium P, and is a substantially colorless ink which does not contain a coloring material of an effective amount. In addition, as illustrated in FIG. 3A, the recording head 7 according to the embodiment is provided with a first nozzle column N1 as a first ejecting unit which ejects the first ink I1, and a second nozzle column N2 as a second ejecting unit which ejects the second ink I2 as nozzle columns N. In detail, the first nozzle column N1 and the second nozzle column N2 are arranged at an overlapping position when viewed in the reciprocating direction B, and the second nozzle column N2 is provided so as to interpose the first nozzle column N1 in the reciprocating direction B. Here, in the first nozzle column N1, nozzle columns N which can eject ink of the same color are provided by interposing the second nozzle column N2. In this specification, the expression "nozzle column" includes a plurality of nozzle columns. In this embodiment, the first nozzle column N1 lies on either side of the second nozzle column N2.

Here, when recording is performed on the recording medium P using the ink for image forming (first ink I1) and the permeation ink (second ink I2), since a coloring material of the color ink is dispersed in the entire thickness direction of the recording medium P, there is a case in which density of an image becomes lower than density which is assumed by a user.

Therefore, the recording apparatus 1 according to the embodiment has a configuration in which it is possible to perform recording by increasing an ejecting amount of the first ink I1 when performing recording using the first ink I1 as the ink for image forming along with the second ink I2 as the permeation ink, when the control unit 23 controls ejecting of the ink I from the first nozzle column N1 and the second nozzle column N2. For example, it is a configuration in which it is possible to perform recording by increasing an ejecting amount of the first ink I1 by 1.5 times in a case in which recording is performed using the first ink I1 along with the second ink I2, compared to a case in which recording is performed using only the first ink I1 without using the second ink I2.

Specifically, recording is performed using the second nozzle column N2, and the first nozzle columns N1 on both sides of the second nozzle column N2 in the reciprocating direction B, in both cases of a case in which recording is performed while moving the carriage 19 in the outward direction B1 (causing ink I to be ejected) in the reciprocating direction B which is illustrated in FIG. 3B, and a case in which recording is performed while moving the carriage 19 in the return direction B2 in the reciprocating direction B which is illustrated in FIG. 3C. That is, ejecting operations of twice of the first ink I1 are performed with respect to one ejecting operation of the second ink I2. In addition, directions in the figure, and a correspondence between the outward direction B1 and the return direction B2 may be reversed.

By performing recording in this manner, it is possible to suppress density of an image becoming low compared to density which is assumed by a user, even when recording is performed using the first ink I1 as the ink for image forming along with the second ink I2 as the permeation ink.

In conclusion, the recording apparatus 1 according to the embodiment includes the recording head 7 which can eject the first ink I1 as the ink for image forming and the second ink I2 as the permeation ink onto the recording medium P, and a control unit 23 which can control ejecting operations of the first ink I1 and second ink I2 in the recording head 7.

In addition, the control unit 23 performs a plurality of ejecting operations of the first ink I1 with respect to one ejecting operation of the second ink I2 so that at least a part of a landing position of the first ink I1 and a landing position of the second ink I2 overlap on the recording medium P.

That is, the recording apparatus 1 according to the embodiment can perform the plurality of ejecting operations of the first ink I1 at a portion at which density of an image tends to be lower than density of an image which is assumed when the second ink I2 lands. For this reason, it is possible to suppress density of the first ink I1 becoming low.

In addition, in the carriage 19 according to the embodiment, an arrangement in which one second nozzle column N2 is interposed between the plurality of first nozzle columns N1 of one set is adopted; however, it is not limited to such a configuration, and may be an arrangement in which one second nozzle column N2 is interposed between first nozzle column N1 of one set, an arrangement in which a plurality of the second nozzle columns N2 are interposed between the first nozzle columns N1 of one set, an arrangement in which a plurality of the second nozzle columns N2 are interposed between a plurality of the first nozzle columns N1 of one set, and the like.

In addition, the recording apparatus 1 according to the embodiment has a configuration in which the recording head 7 is caused to execute ejecting operations of twice of the first ink I1 with respect to one ejecting operation of the second ink I2. However, it may be a configuration in which the recording head 7 is caused to execute ejecting operations of three times or more of the first ink I1 with respect to one ejecting operation of the second ink I2.

In addition, as described above, the recording apparatus 1 according to the embodiment can cause the first ink I1 to be ejected from the first nozzle column N1, and the second ink I2 to be ejected from the second nozzle column N2 while causing the recording head 7 to reciprocate in the reciprocating direction B under a control of the control unit 23. In addition, as illustrated in FIGS. 3A to 3C, the first nozzle columns N1 are provided on both sides of the second nozzle column N2 in the reciprocating direction B.

The recording apparatus 1 according to the embodiment can execute a plurality of ejecting operations of the first ink I1 along with each movement in the outward direction B1 and the return direction B2 in the reciprocating direction B with such a configuration.

Here, the control unit 23 according to the embodiment can cause the plurality of ejecting operations of the first ink I1 which are executed along with a movement in one direction of the outward direction B1 and the return direction B2 (each ejecting operation of first nozzle column N1 on both sides of second nozzle column N2) to be executed so that each ejecting amount of the first nozzle column N1 on both sides of the ejecting operation of the second nozzle column N2 becomes equal. In this manner, it is possible to make the first ink I1 equally permeate into the recording medium P by making each ejecting amount of the plurality of ejecting operations of the first ink I1 equal.

In addition, the control unit 23 according to the embodiment can cause each ejecting operation of the first nozzle columns N1 on both sides of the second nozzle column N2 to be executed so that an ejecting amount of the first nozzle column N1 on the front side in the movement direction of the recording head 7, during a movement, in the reciprocating direction B is larger than an ejecting amount of the first nozzle column N1 on the rear side. In other words, it is possible to execute the plurality of ejecting operations of the first ink I1 which is executed along with a movement in one direction of the outward direction B1 and the return direction B2 so that the ejecting amount in the previous ejecting operation becomes larger than the ejecting amount in the subsequent ejecting operation.

That is, it is possible to reduce an ejecting amount of the first nozzle column N1 on the rear side in the movement direction, during a movement of the recording head 7. Here, when an ejecting amount of the first nozzle column N1 on the rear side in the movement direction of the recording head 7 is large, a curtain of the ink I which is ejected from the first nozzle column N1 on the rear side occurs. When the curtain of the ink I occurs on the rear side, an escape route of ink mist Im of the ink I which is ejected from the first nozzle column N1 on the front side is shut off, and the ink mist Im easily contaminates the recording medium P, or the like, by being attached to the recording head 7. Therefore, the recording apparatus 1 according to the embodiment has a configuration in which it is possible to prevent ink mist Im from contaminating the recording medium P by being attached to the recording head 7, when the control unit 23 can execute such a control.

In addition, the control unit 23 according to the embodiment can cause each ejecting operation of the first nozzle columns N1 on both sides of the second nozzle column N2 to be executed so that the ejecting amount of the first nozzle column N1 on the front side in the movement direction of the recording head 7 during a movement in the reciprocating direction B becomes smaller than the ejecting amount of the first nozzle column N1 on the rear side. In other words, it is possible to cause the plurality of ejecting operations of the first ink I1 which are executed along with a movement in one direction of the outward direction B1 and the return direction B2 to be executed so that the ejecting amount in the previous ejecting operation becomes smaller than the ejecting amount in the subsequent ejecting operation.

As the configuration of the recording apparatus 1 according to the embodiment, when the previous ejecting operation in the plurality of ejecting operations of the first ink I1 is performed previous to the ejecting operation of the second ink I2, and the subsequent ejecting operation in the plurality of ejecting operations of the first ink I1 is performed after the ejecting operation of the second ink I2, it is possible to increase permeability of the first ink I1 with respect to the recording medium P by setting the ejecting amount in the previous ejecting operation to be smaller than the ejecting amount in the subsequent ejecting operation.

As illustrated in FIG. 3A, the carriage 19 according to the embodiment includes the recording head 7 which is provided with both the first nozzle column N1 and the second nozzle column N2. In this manner, the recording apparatus 1 according to the embodiment suppresses attaching of the ink mist Im in a configuration of including separate recording heads 7 for the first nozzle column N1 and the second nozzle column N2 respectively in the carriage 19. However, it is not limited to such a configuration.

Figure 4A:
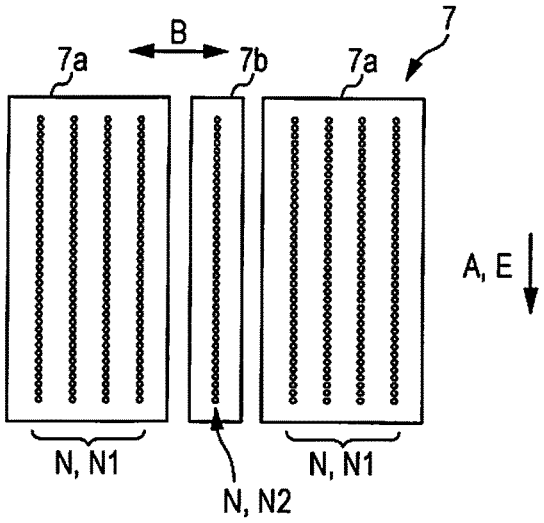
FIGS. 4A to 4C are schematic views which illustrate main portions of a recording apparatus according to a second embodiment of the invention.
Figure 4B:
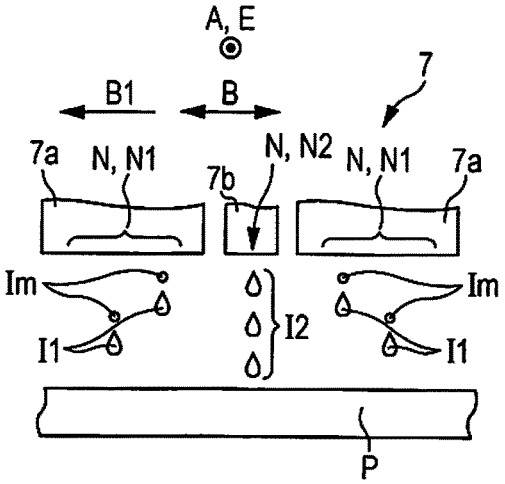
Figure 4C:
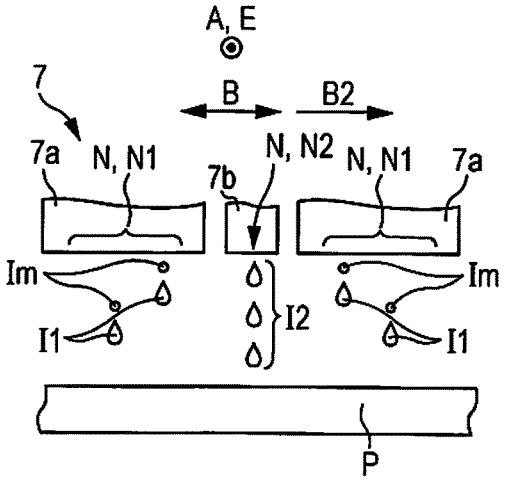

Second Embodiment (FIGS. 4A to 4C)

Subsequently, a recording apparatus according to a second embodiment of the invention will be described.

FIGS. 4A to 4C are schematic views which illustrate a recording head 7 which is provided in a carriage 19 as a main portion of a recording apparatus 1 according to the second embodiment of the invention. Among these, FIG. 4A is a schematic bottom view of the recording head 7, and corresponds to FIG. 3A which illustrates the recording apparatus 1 according to the first embodiment. In addition, FIGS. 4B and 4C are schematic front views of the recording head 7, and correspond to FIGS. 3B and 3C which illustrate the recording apparatus 1 according to the first embodiment.

In addition, constituent elements which are common to those in the first embodiment will be given the same reference numerals, and detailed descriptions will be omitted.

The recording apparatus 1 according to the embodiment is different from the recording apparatus 1 according to the first embodiment only in a configuration of the recording head 7 which is provided in the carriage 19.

The carriage 19 according to the first embodiment is provided with the recording head 7 in which both the first nozzle column N1 and the second nozzle column N2 are provided.

On the other hand, as illustrated in FIGS. 4A to 4C, the carriage 19 according to the embodiment has a configuration of including two recording heads 7*a* in which the first nozzle column N1 is provided, and a recording head 7*b* in which the second nozzle column N2 is provided as the recording head 7. That is, in the embodiment, it is also possible to express that, in the recording head 7*a* and the recording head 7*b* as the ejecting unit, the recording head 7*a* is a first ejecting unit, and the recording head 7*b* is a second ejecting unit.

As illustrated in FIGS. 4A to 4C, the recording apparatus 1 according to the embodiment includes the carriage 19 which has the recording head 7*a* in which the first nozzle column N1 is provided, and the recording head 7*b* in which the second nozzle column N2 is provided. In addition, a positional relationship between the first nozzle column N1 and the second nozzle column N2, and a control method thereof are the same as those in the carriage 19 according to the first embodiment.

That is, the recording apparatus 1 according to the embodiment has a configuration in which it is possible to suppress low density of the first ink I1, similarly to the recording apparatus according to the first embodiment, in a configuration in which the carriage 19 includes the recording head 7*a* in which the first nozzle column N1 is provided, and the recording head 7*b* in which the second nozzle column N2 is provided.

Figure 5A:
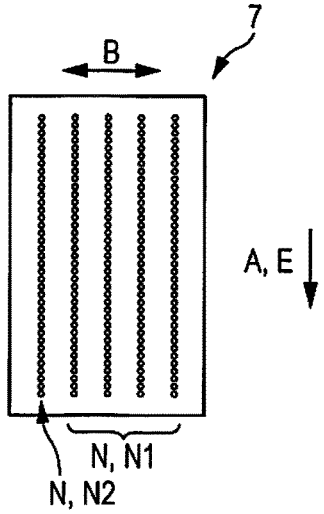
FIGS. 5A to 5C are schematic views which illustrate main portions of a recording apparatus according to a third embodiment of the invention.
Figure 5B:
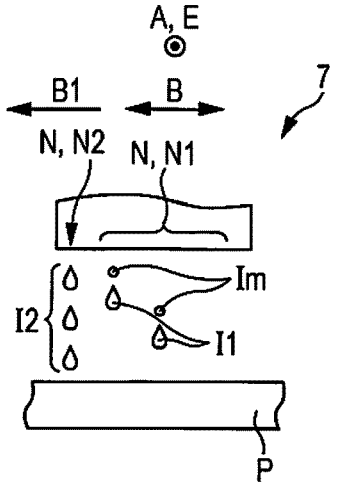
Figure 5C:
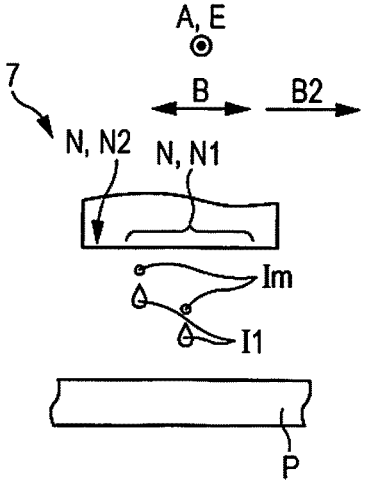

Third Embodiment (FIGS. 5A to 5C)

Subsequently, a recording apparatus according to a third embodiment of the invention will be described.

FIGS. 5A to 5C are schematic views which illustrate a recording head 7 which is provided in a carriage 19 as a main portion of a recording apparatus 1 according to the third embodiment of the invention. Among these, FIG. 5A is a schematic bottom view of the recording head 7, and corresponds to FIG. 3A which illustrates the recording apparatus 1 according to the first embodiment. In addition, FIGS. 5B and 5C are schematic front views of the recording head 7, and correspond to FIGS. 3B and 3C which illustrate the recording apparatus 1 according to the first embodiment.

In addition, constituent elements which are common to those in the first and the second embodiments will be given the same reference numerals, and detailed descriptions will be omitted.

The recording apparatus 1 according to the embodiment is different from the recording apparatus 1 according to the first and second embodiments only in a configuration of the recording head 7 which is provided in a carriage 19, and a control method thereof.

The carriage 19 in the first and second embodiments has a configuration in which the first nozzle columns N1 are provided on both sides of the second nozzle column N2 in the scanning direction B.

Meanwhile, as illustrated in FIGS. 5A to 5C, the carriage 19 according to the embodiment has a configuration in which the first nozzle column N1 is provided only one side of the second nozzle column N2 in the reciprocating direction B.

As illustrated in FIGS. 5A to 5C, in the recording apparatus 1 according to the embodiment, the first nozzle column N1 is provided on one side of the second nozzle column N2 in the reciprocating direction B. In addition, similarly to the recording apparatus in the first and second embodiments, the recording head 7 can eject the first ink I1 from the first nozzle column N1, and eject the second ink I2 from the second nozzle column N2 while reciprocating in the reciprocating direction B.

Here, the control unit 23 according to the embodiment can perform a control of causing the recording head 7 to execute at least one ejecting operation of the first ink I1 with respect to the same recording region, in both the outward direction B1 and the return direction B2 in the reciprocating direction B. Specifically, as illustrated in FIG. 5B, the control unit causes the first ink I1 to be ejected from the first nozzle column N1, and the second ink I2 to be ejected from the second nozzle column N2 while moving the recording head 7 in the outward direction B1. In addition, as illustrated in FIG. 5C, the control unit causes the first ink I1 to be ejected from the first nozzle column N1 while moving the recording head 7 in the return direction B2 without transporting the recording medium P, that is, in the same recording region as the recording region at a time of a movement in the outward direction B1.

When the control unit 23 performs such a control using the recording head 7 with such a configuration, it is possible to execute the plurality of ejecting operations of the first ink I1 without increasing the number of ejecting units, that is, it is possible to suppress low density of the first ink I1.

In addition, as described above, the recording apparatus 1 according to the embodiment can cause the first ink I1 to be ejected, and cause the second ink I2 to be ejected while moving the recording head 7 in the outward direction B1, and can cause only the second ink I2 to be ejected while moving the recording head 7 in the return direction B2. However, it is not limited to such ejecting mode of the ink I, and may be a mode, for example, in which the first ink I1 is caused to be ejected, and the second ink I2 is caused to be ejected while moving the recording head 7 in the outward direction B1, and the first ink I1 is caused to be ejected, and the second ink I2 is caused to be ejected while moving the recording head 7 in the return direction B2.

Figure 6A:
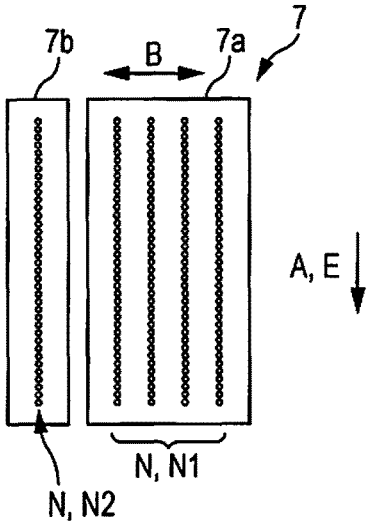
FIGS. 6A to 6C are schematic views which illustrate main portions of a recording apparatus according to a fourth embodiment of the invention.
Figure 6B:
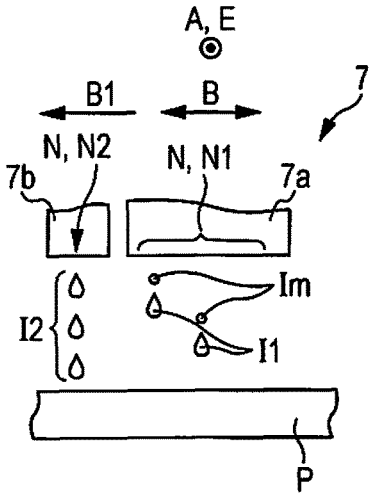
Figure 6C:
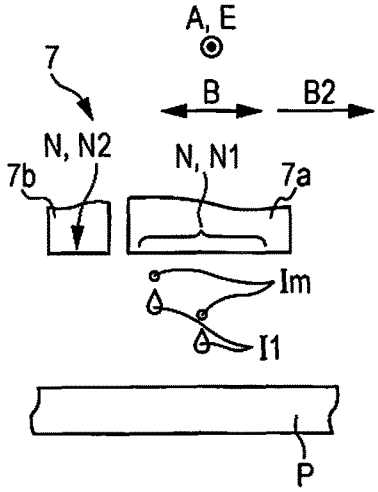

Fourth Embodiment (FIGS. 6A to 6C)

Subsequently, a recording apparatus according to a fourth embodiment of the invention will be described.

FIGS. 6A to 6C are schematic views which illustrate a recording head 7 which is provided in a carriage 19 as a main portion of a recording apparatus 1 according to the fourth embodiment of the invention. Among these, FIG. 6A is a schematic bottom view of the recording head 7, and corresponds to FIG. 3A which illustrates the recording apparatus 1 according to the first embodiment. In addition, FIGS. 6B and 6C are schematic front views of the recording head 7, and correspond to FIGS. 3B and 3C which illustrate the recording apparatus 1 according to the first embodiment.

In addition, constituent elements which are common to those in the first to third embodiments will be given the same reference numerals, and detailed descriptions will be omitted.

The recording apparatus 1 according to the embodiment is different from the recording apparatus 1 according to the third embodiment only in a configuration of the recording head 7 which is provided in the carriage 19.

The carriage 19 according to the third embodiment has a configuration of including the recording head 7 in which both the first nozzle column N1 and the second nozzle column N2 are provided.

On the other hand, as illustrated in FIGS. 6A to 6C, the carriage 19 according to the embodiment has a configuration of including a recording head 7*a* in which the first nozzle column N1 is provided, and a recording head 7*b* in which the second nozzle column N2 is provided as the recording head 7. In addition, a positional relationship between the first nozzle column N1 and the second nozzle column N2, and a control method thereof are the same as those in the carriage 19 according to the third embodiment.

That is, the recording apparatus 1 according to the embodiment has a configuration in which it is possible to execute a plurality of ejecting operations of the first ink I1 without increasing the number of ejecting units, similarly to the recording apparatus according to the third embodiment, that is, it is possible to suppress low density of the first ink I1.

In addition, the invention is not limited to above described embodiments, can be variously modified in the scope of the invention which is described in claims, and it is needless to say that those are also included in the scope of the invention.

Hitherto, the invention has been described in detail based on specific embodiments. Here, the invention will be collectively described once again.

A recording apparatus 1 according to a first aspect of the invention includes an ejecting unit 7 which can eject first ink I1 for image forming and colorless second ink I2 onto a recording medium P; and a control unit 23 which can control ejecting operations of the first ink I1 and the second ink I2 in the ejecting unit 7, in which the control unit 23 performs a plurality of ejecting operations of the first ink I1 with respect to one ejecting operation of the second ink I2, so that at least a part of a landing position of the second ink I2 and a landing position of the first ink I1 overlap on the recording medium P.

According to the aspect, the control unit 23 can perform a control in which the ejecting unit 7 is caused to perform a plurality of ejecting operations of the first ink I1 with respect to one ejecting operation of the second ink I2. That is, the control unit 23 can suppress low density of the first ink I1 at a portion at which density of an image tends to be lower than density of an image which is assumed when the second ink I2 lands, by causing the plurality of ejecting operations of the first ink I1 to be executed.

In the recording apparatus 1 according to a second aspect, in the first aspect, the ejecting unit 7 can eject the first ink I1 from a first ejecting unit N1, and the second ink I2 from a second ejecting unit N2 while reciprocating in a reciprocating direction B, and the first ejecting units N1 are provided on both sides of the second ejecting unit N2 in the reciprocating direction B.

According to the aspect, the first ejecting units N1 are provided on both sides of the second ejecting unit N2 in the reciprocating direction B. For this reason, it is possible to cause a plurality of ejecting operations of the first ink I1 to be executed along with a movement in one direction of the outward direction B1 and the return direction B2 in the reciprocating direction B.

In the recording apparatus 1 according to a third aspect, in the first aspect, the ejecting unit 7 can eject the first ink I1 from the first ejecting unit N1, and the second ink I2 from the second ejecting unit N2 while reciprocating in the reciprocating direction B, and the control unit 23 performs an ejecting operation of the first ink I1 of at least once with respect to the same recording region in both the outward direction B1 and the return direction B2 in the reciprocating direction B.

According to the aspect, the control unit 23 can perform a control of causing the ejecting unit 7 to execute an ejecting operation of the first ink I1 of at least once in both the outward direction B1 and the return direction B2 in the reciprocating direction B. For this reason, it is possible to execute the plurality of ejecting operations of the first ink I1 without increasing the number of ejecting units 7.

In the recording apparatus 1 according to a fourth aspect, in any one of the first to third aspects, the control unit 23 can execute the plurality of ejecting operations of the first ink I1 so that each ejecting amount becomes equal.

According to the aspect, the control unit 23 executes the plurality of ejecting operations of the first ink I1 so that each ejecting amount becomes equal. It is possible to cause the first ink I1 to equally permeate into the recording medium P by making each ejecting amount of the first ink I1 in the plurality of ejecting operations equal.

In the recording apparatus 1 according to a fifth aspect, in any one of the first to third aspects, the control unit 23 executes the plurality of ejecting operations of the first ink I1 so that an ejecting amount in the previous ejecting operation is larger than an ejecting amount in the subsequent ejecting operation.

According to the aspect, the control unit 23 executes the plurality of ejecting operations of the first ink I1 so that an ejecting amount in the previous ejecting operation is larger than an ejecting amount in the subsequent ejecting operation. For this reason, for example, in a configuration of including the ejecting unit 7 which can eject the ink I while reciprocating in the reciprocating direction B, it is possible to reduce an ejecting amount of the ejecting unit 7 on the rear side in the movement direction B, by setting the plurality of ejecting operations of the first ink I1 so that an ejecting amount in the previous ejecting operation is larger than an ejecting amount in the subsequent ejecting operation. Here, when an ejecting amount of the ejecting unit 7 on the rear side in the movement direction is large, an escape route of the ink mist Im of ink which is ejected from the ejecting unit 7 on the front side is shut off due to a curtain of the ink I which is ejected from the ejecting unit 7 on the rear side, and the ink mist Im contaminates a medium P, or the like, by being attached to the ejecting unit. That is, according to the aspect, it is possible to suppress contamination of the medium P which is caused by the ink mist Im attached to the ejecting unit 7.

In the recording apparatus 1 according to a sixth aspect, in any one of the first to third aspects, the control unit 23 executes the plurality of ejecting operations of the first ink I1 so that an ejecting amount in the previous ejecting operation is smaller than an ejecting amount in the subsequent ejecting operation.

According to the aspect, the control unit 23 executes the plurality of ejecting operations of the first ink I1 so that an ejecting amount in the previous ejecting operation is smaller than an ejecting amount in the subsequent ejecting operation. For example, when the previous ejecting operation in the plurality of ejecting operations of the first ink I1 is performed prior to an ejecting operation of the second ink I2, and the subsequent ejecting operation in the plurality of ejecting operations of the first ink I1 is performed after the ejecting operation of the second ink I2, it is possible to increase permeability of the first ink I1 with respect to the medium P, by setting so that the ejecting amount in the previous ejecting operation is smaller than the ejecting amount of the subsequent ejecting operation.

According to an aspect of the embodiment, there is provided a recording apparatus which includes an ejecting unit which can eject first ink for image forming and colorless second ink onto a recording medium; and a control unit which can control ejecting operations of the first ink and the second ink in the ejecting unit, in which the control unit performs a plurality of ejecting operations of the first ink with respect to one ejecting operation of the second ink, so that at least a part of a landing position of the second ink and a landing position of the first ink overlap on the recording medium.

In the recording apparatus, the ejecting unit may be able to eject the first ink from a first ejecting unit, and the second ink from a second ejecting unit while reciprocating in a reciprocating direction, and the first ejecting unit may be provided on both sides of the second ejecting unit in the reciprocating direction.

In the recording apparatus, the ejecting unit may be able to eject the first ink from the first ejecting unit, and the second ink from the second ejecting unit while reciprocating in the reciprocating direction, and the control unit may perform an ejecting operation of the first ink at least once with respect to the same recording region in both an outward direction and a return direction in the reciprocating direction.

In the recording apparatus, the control unit may execute a plurality of ejecting operations of the first ink so that each ejecting amount becomes equal.

In the recording apparatus, the control unit may execute the plurality of ejecting operations of the first ink so that an ejecting amount in the previous ejecting operation is larger than an ejecting amount in the subsequent ejecting operation.

In the recording apparatus, the control unit may execute the plurality of ejecting operations of the first ink so that an ejecting amount in the previous ejecting operation is smaller than an ejecting amount in the subsequent ejecting operation.

According to the aspect of the embodiment, it is possible to suppress low density of an image in a case in which the image is formed by ejecting ink for image forming and permeation ink.

What is claimed is:

1. A recording method comprising:

ejecting a first ink for image forming and a substantially colorless second ink onto a recording surface of a recording medium at an ejecting unit, the second ink being permeation ink configured to permeate the first ink into the recording medium from the recording surface to an opposite surface of the recording medium, the opposite surface being opposite the recording surface; and controlling ejecting operations of the first ink and the second ink in the ejecting unit, the controlling including performing a plurality of ejecting operations of the first ink with respect to one ejecting operation of the second ink, so that at least a part of a landing position of the second ink and a landing position of the first ink overlap on the recording medium.

2. The recording method according to claim 1, wherein the ejecting includes ejecting the first ink from a first ejecting unit, and the second ink from a second ejecting unit while reciprocating the ejecting unit in a reciprocating direction, and the first ejecting unit is provided on both sides of the second ejecting unit in the reciprocating direction.

3. The recording method according to claim 1, wherein the ejecting includes ejecting the first ink from a first ejecting unit, and the second ink from a second ejecting unit while reciprocating the ejecting unit in a reciprocating direction, and the controlling includes performing an ejecting operation of the first ink at least once with respect to the same recording region in both an outward direction and a return direction in the reciprocating direction.

4. The recording method according to claim 1, wherein the controlling includes executing a plurality of ejecting operations of the first ink so that each ejecting amount becomes equal.

5. The recording method according to claim 1, wherein the controlling includes executing a plurality of ejecting operations of the first ink so that an ejecting amount in the previous ejecting operation is larger than an ejecting amount in the subsequent ejecting operation.

6. The recording method according to claim 1, wherein the controlling includes executing a plurality of ejecting operations of the first ink so that an ejecting amount in the previous ejecting operation is smaller than an ejecting amount in the subsequent ejecting operation.

7. The recording method according to claim 1, wherein the ejecting includes ejecting the first ink and the second ink at the ejecting unit that includes a first ejecting unit configured to eject the first ink and a second ejecting unit configured to eject the second ink, the first ejecting unit has a plurality of first nozzle columns and a plurality of second nozzle columns, the plurality of the first nozzle columns is arranged in a first direction relative to the second ejecting unit, the plurality of the second nozzle columns is arranged in a second direction relative to the second ejecting unit, and the second direction is opposite the first direction.

8. The recording method according to claim 7, wherein a number of the plurality of the first nozzle columns is equal to a number of the plurality of the second nozzle columns.

9. A recording method comprising:

moving an ejecting unit in a reciprocating direction;

ejecting a first ink for image forming and a substantially colorless second ink onto a recording surface of a recording medium by the ejecting unit, the second ink being permeation ink configured to permeate the first ink into the recording medium from the recording surface to an opposite surface of the recording medium, the opposite surface being opposite the recording surface; and controlling ejecting operations of the first ink and the second ink in the ejecting unit, the controlling including controlling the ejecting unit to perform a plurality of ejecting operations of the first ink with respect to at least one ejecting operation of the second ink, and the controlling including controlling the ejecting unit to eject both of the first ink and the second ink while the ejecting unit is moving in one direction of the reciprocating direction, and controlling the ejecting unit to eject both of the first ink and the second ink while the ejecting unit is moving in an opposite direction of the reciprocating direction, the opposite direction being opposite the one direction.

10. A recording method comprising:

ejecting a first ink for image forming onto a recording surface of a recording medium by a plurality of first nozzle columns of an ejecting unit and ejecting a substantially colorless second ink onto the recording surface of the recording medium by a second nozzle column of the ejecting unit, the first nozzle columns being arranged symmetrically with respect to the second nozzle column, the second ink being permeation ink configured to permeate the first ink into the recording medium from the recording surface to an opposite surface of the recording medium, the opposite surface being opposite the recording surface; and controlling ejecting operations of the first ink and the second ink in the ejecting unit, the controlling including controlling the ejecting unit to perform a plurality of ejecting operations of the first ink with respect to one ejecting operation of the second ink.

11. The recording method according to claim 10, wherein the first nozzle columns are arranged symmetrically with respect to the second nozzle column in a reciprocating direction in which the ejecting unit reciprocates.

12. A recording apparatus comprising:

an ejecting unit configured to move in a reciprocating direction and to eject a first ink for image forming and a substantially colorless second ink onto a recording surface of a recording medium, the second ink being permeation ink configured to permeate the first ink into the recording medium from the recording surface to an opposite surface of the recording medium, the opposite surface being opposite the recording surface; and a control unit which is configured to control ejecting operations of the first ink and the second ink in the ejecting unit, the control unit being arranged to control the ejecting unit to perform a plurality of ejecting operations of the first ink with respect to at least one ejecting operation of the second ink, the control unit being arranged to control the ejecting unit to eject both of the first ink and the second ink while the ejecting unit is moving in one direction of the reciprocating direction, and control the ejecting unit to eject both of the first ink and the second ink while the ejecting unit is moving in an opposite direction of the reciprocating direction, the opposite direction being opposite the one direction.

13. A recording apparatus comprising:

an ejecting unit which includes a plurality of first nozzle columns configured to eject a first ink for image forming and a second nozzle column configured to eject a substantially colorless second ink onto a recording surface of a recording medium, the second ink being permeation ink configured to permeate the first ink into the recording medium from the recording surface to an opposite surface of the recording medium, the opposite surface being opposite the recording surface; and a control unit which is configured to control ejecting operations of the first ink and the second ink in the ejecting unit, the control unit being arranged to control the ejecting unit to perform a plurality of ejecting operations of the first ink with respect to one ejecting operation of the second ink, the first nozzle columns being arranged symmetrically with respect to the second nozzle column.

14. The recording apparatus according to claim 13, wherein the first nozzle columns are arranged symmetrically with respect to the second nozzle column in a reciprocating direction in which the ejecting unit reciprocates.

* * * * *